United States Patent [19]

Seidl

[11] 4,125,245

[45] Nov. 14, 1978

[54] TOP RAIL TIE BRACKET FOR CONCRETE FORMS

[76] Inventor: Ludwig J. Seidl, 1637 Seaton St., Pittsburgh, Pa. 15226

[21] Appl. No.: 769,537

[22] Filed: Feb. 17, 1977

[51] Int. Cl.[2] ..... E04G 17/08

[52] U.S. Cl. ..... 249/33; 249/41; 249/46; 249/214; 249/216; 249/219 W

[58] Field of Search ..... 249/40–46, 249/190, 191, 213, 214, 216, 217, 219 R, 219 W, 33

[56] References Cited

U.S. PATENT DOCUMENTS

| | | | |
|---|---|---|---|
| 2,017,553 | 10/1931 | Troiel | 249/41 |
| 2,818,629 | 1/1958 | Wenberg | 249/191 |
| 2,902,744 | 9/1959 | Patterson et al. | 249/219 W |

*Primary Examiner*—Francis S. Husar
*Assistant Examiner*—John McQuade
*Attorney, Agent, or Firm*—William J. Ruano

[57] ABSTRACT

A top rail tie bracket for concrete forms for eliminating the usual additional wooden rail required across the top of the top rail of the form for bracing the wedging element of the top snap tie rod. A reusable T-shaped bracket is provided, one leg of which abuts the top rail and the other leg serves as a back-up support to overcome the tensioning action of the wedge on the top snap tie rod. This eliminates the necessity of the additional top rail.

2 Claims, 5 Drawing Figures

TOP RAIL TIE BRACKET FOR CONCRETE FORMS

This invention relates to apparatus for fastening the top snap tie rod of a concrete form without the necessity of using an additional top wooden rail.

An outstanding disadvantage of conventional apparatus for forming concrete walls and the like is that the top snap tie rod must be tensioned by a wedge which creates great stress thereon, requiring the addition of wooden top rails on the existing top rails of the form solely to serve as a back-up support for the wedge during the wedging action. This has the disadvantage of requiring such additional top rails and nailing them to the existing top rails and unfastening them after the form is no longer needed, thereby involving a costly inventory as well as greater time for erecting and dismantling the wall form.

An object of my invention is to overcome the above-named disadvantages of existing wall forms by providing a novel bracket which makes it unneccessary to provide the long and costly additional wooden top rail for backing up the wedge when driving the wedge to tension the top snap tie rod.

Another object of the invention is to provide a novel top rail tie bracket which is relatively simple in construction, inexpensive to manufacture and highly effective in backing up tensile stresses on the top rail snap tie rod, also reusable.

Other objects and advantages will become more apparent from a study of the following description taken with the accompanying drawing wherein:

FIG. 1 is a fragmentary, elevational view of a form comprising a plurality of snap tie rods and wedges for forming a concrete vertical wall or the like;

Figure 1:
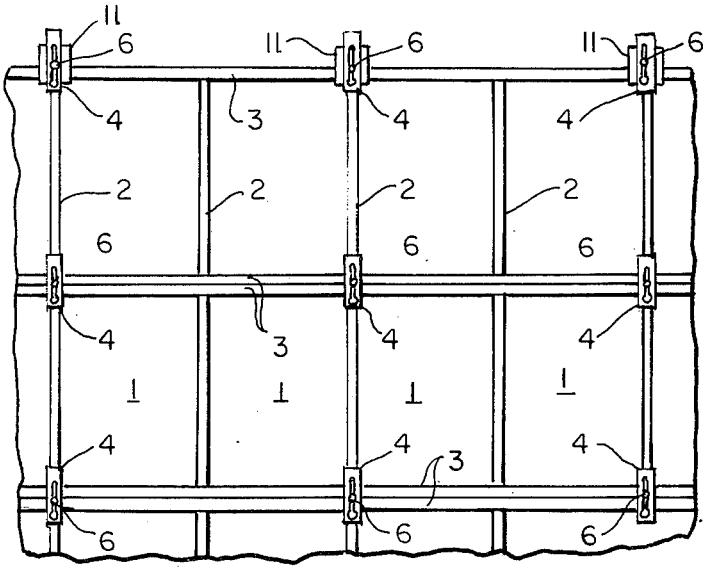

Referring more particularly to the drawing, numeral 1 denotes a pair of form panels in vertically spaced relationship, made of wood or other suitable material, and supported outside thereof by a pair of vertical studs 2, such as wooden two by fours.

Figure 4:
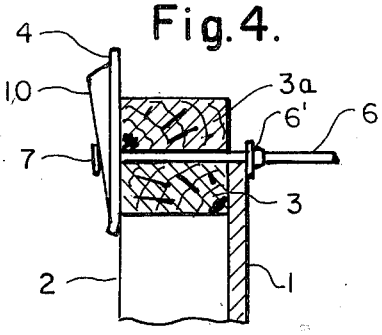
FIG. 4 is a fragmentary, vertical cross-sectional view of a common method of assembling the top tie rod of a concrete form.

In building a high concrete wall C, a plurality of wedges, such as 4, are provided which, when driven into wedging relationship, to apply tension to snap tie rods, such as 6, normally would require an additional top wooden rail 3*a*, such as shown in FIG. 4, to resist the tensile stresses placed on the rods.

Figure 2:
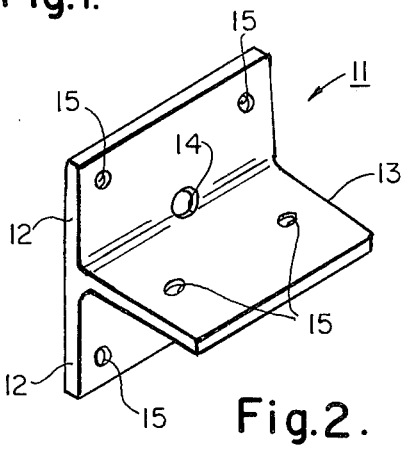
FIG. 2 is an enlarged, elevational view of a bracket embodying the principles of the present invention.
Figure 3:
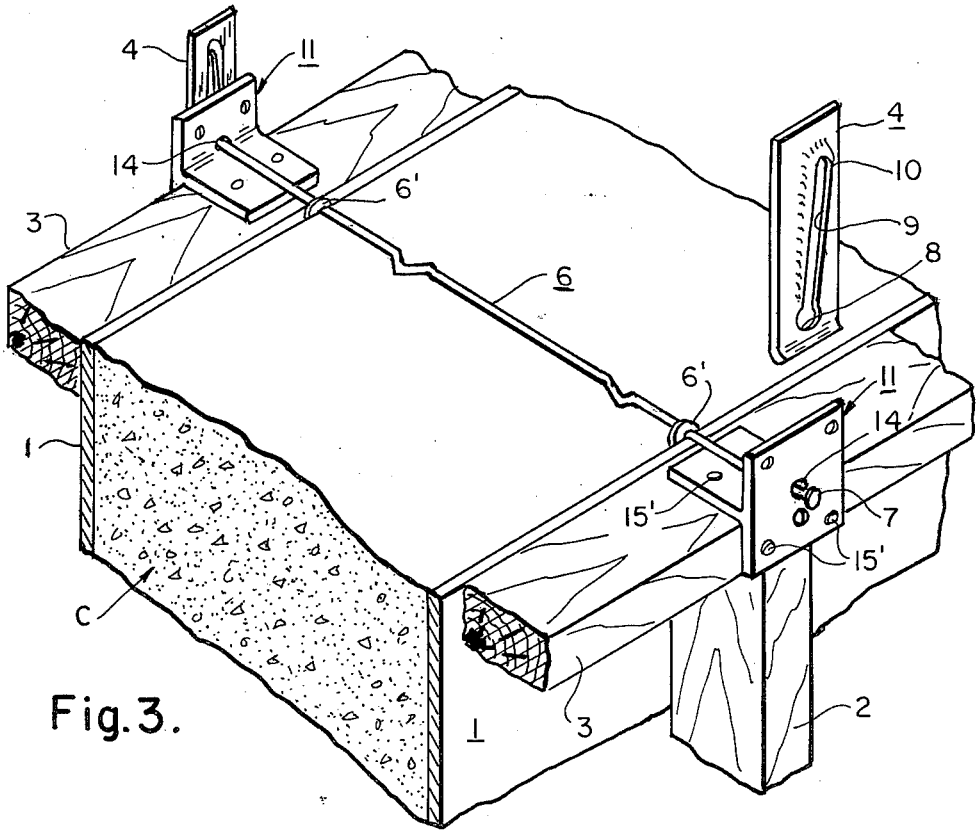
FIG. 3 is a top, perspective view showing the top of a wall form embodying the snap tie rod wedge and bracket of FIG. 2, the wedge being shown exploded or separated from the end of the rod for clarity of illustration.
Figure 4A:
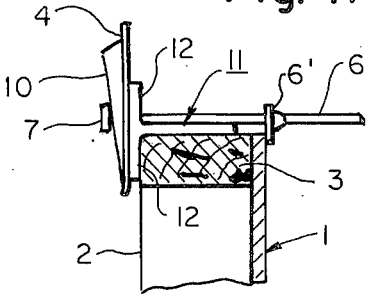
FIG. 4A is a similar view, in vertical cross-section, showing the application of the bracket of FIG. 2, embodying the present invention, which eliminate the necessity of the additional wooden top rail 3*a* of FIG. 4.

However, in accordance with the present invention, shown more clearly in FIGS. 2,3 and 4A, an additional bracket, generally denoted by numeral 11, as shown in FIG. 2, is provided comprising essentially a metallic bracket of T cross-section having flanges 12,12 which extend vertically, one of which flanges is backed up or braced by the top wooden rail 3 (FIG. 3). Bracket 11 has a pair of holes 14 in flange or leg 13 through which the end of snap tie rod 6 projects together with the head or button 7 of such rod. The snap tie washers 6' are provided flush against the outer surface of form panels 1 with a spacing depending upon the thickness of the concrete wall.

In operation, brackets 11 are fastened to the top rails 3,3 by nailing nails 15' through holes 15 into the top rails. It will be noted that flange 11 is vertically reversible. Then the headed end of the snap tie rods is projected through a hole 14, as shown in FIG. 3, so that upon subsequent insertion of the hole 8 of the wedge 4 through head 7, and driving the inclined surface 10 downwardly, in sliding engagement with flanges 12,12 while head 7 moves along slot 9, rod 6 will become tensioned so as to tightly clamp the side form panels 1,1. The tie rods 6 have a pair of kinks in them, as shown, to prevent turning movement. They may also be provided near their ends with sections of reduced diameter to enable breaking off the end portions in case they are located centrally, rather than on top of the wall. The tie rod 6 has heads 7 at both ends which are wedged by wedges 4,4. A plurality of such rods are provided throughout the height of the wall C.

After curing of the concrete, the brackets 11 are easily removed from the assembly and are in readiness for use when assembling the next form.

Thus it will be seen that I have provided a highly efficient and relatively inexpensive bracket for a top rail snap tie rod for erecting concrete walls and which eliminates the necessity of an additional top wooden rail to serve as a backup to withstand tensioning forces developed by draving the wedges downwardly to wedge the snap rods.

While I have illustrated and described a single specific embodiment of my invention, it will be understood that this is by way of illustration only and that various changes and modifications may be contemplated in my invention and within the scope of the present claim.

I claim:

1. In combination with a concrete wall forming form comprising a pair of vertical, spaced parallel form panels with horizontal top rails engaging the outer top ends thereof and a snap tie rod extending across the top of the form and top rails and having a head at each end; the improvement comprising a bracket of T-shaped cross section on each end of said rod, each bracket having right angular legs thereof snugly engaging the top and outer sides of the corresponding top rail and having holes therethrough for driving nails into said corresponding top rail, each bracket also having a central hole just above the top surface of the leg engaging the top side of the corresponding top rail, and a wedge between the outer vertical surface of at least one of said brackets and the corresponding head having a keyhole opening and elongated slot for guiding the corresponding head of said tie rod while driving said wedge downwardly in sliding engagement with the outer vertical surface of said at least one bracket so as to apply tension to the tie rod with back-up support by the remaining right angular leg of said at least one bracket.

2. Apparatus recited in claim 1 wherein said tie rod is provided with sections of reduced diameter adjacent its outer ends to enable breaking off the end portions thereof.

* * * * *